US011371202B1

(12) United States Patent
Nozu et al.

(10) Patent No.: US 11,371,202 B1
(45) Date of Patent: Jun. 28, 2022

(54) GROUND IMPROVEMENT APPARATUS AND GROUND IMPROVEMENT METHOD

(71) Applicant: Fudo Tetra Corporation, Tokyo (JP)

(72) Inventors: Mitsuo Nozu, Tokyo (JP); Yuki Imai, Tokyo (JP); Yuji Yamashita, Tokyo (JP)

(73) Assignee: FUDO TETRA CORPORATION, Tokyo (JP)

( * ) Notice: Subject to any disclaimer, the term of this patent is extended or adjusted under 35 U.S.C. 154(b) by 0 days.

(21) Appl. No.: 17/404,472

(22) Filed: Aug. 17, 2021

(30) Foreign Application Priority Data

Jan. 6, 2021 (JP) ..... JP2021-000677

(51) Int. Cl.
*E02D 3/12* (2006.01)
*E02D 5/46* (2006.01)

(52) U.S. Cl.
CPC ..... *E02D 3/126* (2013.01); *E02D 5/46* (2013.01); *E02D 2250/0038* (2013.01)

(58) Field of Classification Search
CPC ..... E02D 3/126; E02D 2250/0038
See application file for complete search history.

(56) References Cited

FOREIGN PATENT DOCUMENTS

| | | | |
|---|---|---|---|
| CN | 106761453 | | 5/2017 |
| JP | 62-60628 | | 3/1987 |
| JP | 2006-336427 | | 12/2006 |
| JP | 200-70931 | | 3/2007 |
| JP | 2007-70931 | | 3/2007 |
| JP | 2007 211403 | | 8/2007 |
| JP | 2012184612 | * | 9/2012 |

OTHER PUBLICATIONS

Office Action issued in Japan Counterpart Patent Appl. No. 2021-000677, dated Mar. 11, 2021, along with an English translation thereof.

* cited by examiner

*Primary Examiner* — Sean D Andrish
(74) *Attorney, Agent, or Firm* — Greenblum & Bernstein, P.L.C.

(57) ABSTRACT

A ground improvement apparatus includes: an irrotational sun gear fixed to an irrotational inner pipe inside a rotatable outer pipe; a planetary gear rotatably supported on a rotatable agitation shaft and configured to rotate while meshing with the sun gear; and an inverse rotation mechanism meshing with the planetary gear and rotating the agitation shaft in an opposite direction of the planetary gear. The agitation shaft is suspended on a connection member attached to the outer pipe so as to rotate in synchronization with a rotation center of the inverse rotation mechanism. A ground where the outer pipe is penetrated and a solidifying material discharged from the agitation shaft are agitated and mixed with each other by agitation blades radially attached to the agitation shaft with a trajectory of distal ends of the agitation blades drawing a substantially polygonal shape by rotation of the agitation shaft.

10 Claims, 5 Drawing Sheets

0°
15°
30°
45°
60°
75°
90°
135°
180°
225°
270°
14
15
16
17
18
18a
K
(R)

GROUND IMPROVEMENT APPARATUS AND GROUND IMPROVEMENT METHOD

CROSS REFERENCE TO RELATED APPLICATION

This application is based upon and claims the benefit of priority from the prior Japanese Patent Application No. 2021-000677, filed on Jan. 6, 2021, the entire contents of which are incorporated herein by reference.

BACKGROUND

1. Technical Field

The disclosure relates to a ground improvement apparatus and a ground improvement method which form an improved body having a rectangular cross section by applying the principle of Reuleaux triangle.

2. Related Art

As a ground improvement apparatus, there is a ground agitator described in Japanese Unexamined Patent Publication No. 2006-336427. The ground agitator includes a drive mechanism, a discharge mechanism, excavation cutters, and agitation blades. The driving mechanism includes a Reuleaux rotary shaft, a bearing, and a driving unit. The Reuleaux rotary shaft has a cross-section of a Reuleaux triangle shape. The bearing rotatably supports a portion of the Reuleaux triangle shape in a square shape having an outer width of the portion of the Reuleaux triangle shape as a side. The driving unit rotationally drives the Reuleaux rotary shaft. The driving mechanism is provided to be movable in an axial direction of the Reuleaux rotary shaft. The discharge mechanism discharges a sediment solidifying material from a distal end of the Reuleaux rotary shaft extended to a distal surface of the bearing. The excavation cutters are provided at the distal end of the Reuleaux rotary shaft and are formed within a range of the Reuleaux triangle shape in which a gravity center and directions of vertices are matched to the Reuleaux triangle shape of the Reuleaux rotary shaft by enlarging the Reuleaux triangle shape of the Reuleaux rotary shaft. The agitation blades are provided between the bearing of the Reuleaux rotary shaft and the excavation cutters and are formed in the same manner as the excavation cutters.

In the above ground agitator, the solidifying material is discharged from the distal end of the Reuleaux rotary shaft while excavating a substantially rectangular hole by rotation of the Reuleaux rotary shaft, and soil of the ground and the solidifying material are agitated and mixed by the agitation blades to form an underground continuous wall (improved body) having a rectangular cross section.

SUMMARY

In the above ground agitator, the entire apparatus is large in scale. Further, in the above ground agitator, the diameters of the Reuleaux rotary shaft and the bearing portion around the Reuleaux rotary shaft become large and thus the Reuleaux rotary shaft and the bearing portion become a large obstacle (load) when they penetrate into the ground, which makes it difficult to smoothly construct the improved body.

The disclosure is directed to a ground improvement apparatus and a ground improvement method which can make an outer pipe through which an inner pipe having a fixed sun gear is inserted small in diameter and can easily and reliably form an improved body having a substantially polygonal cross section.

A ground improvement apparatus in accordance with some embodiments includes: a double pipe including an outer pipe rotated by a driver and an inner pipe irrotationally arranged inside the outer pipe; an agitation shaft rotatably suspended via a connection member attached to a distal end of the outer pipe at a prescribed distance from the outer pipe so as to be parallel to the outer pipe; a sun gear fixed to a distal end of the inner pipe which is irrotational so as not to rotate; a planetary gear rotatably supported on an upper end side of the agitation shaft and configured to rotate while meshing with the sun gear which is irrotational; and an inverse rotation mechanism configured to mesh with the planetary gear and rotate the agitation shaft in a direction opposite to a rotation direction of the planetary gear. The agitation shaft includes agitation blades radially attached to the agitation shaft and is suspended on the connection member so as to rotate in synchronization with a rotation center of the inverse rotation mechanism. A ground at a location where the outer pipe is penetrated and a solidifying material discharged from a side of the agitation shaft are agitated and mixed with each other by the agitation blades with a trajectory of distal ends of the agitation blades drawing a substantially polygonal shape by rotation of the agitation shaft.

A ground improvement method in accordance with some embodiments includes: rotating an outer pipe of a double pipe by a driver; rotating an agitation shaft suspended via a connection member attached to a distal end of the outer pipe at a prescribed distance from the outer pipe so as to be parallel to the outer pipe; through rotation of the outer pipe, revolving a planetary gear around a sun gear and rotating the planetary gear, the sun gear being irrotational and fixed to a distal end of an inner pipe irrotationally arranged inside the outer pipe, the planetary gear being rotatably supported on an upper end side of the agitation shaft; and through revolution and rotation of the planetary gear, agitating and mixing a ground at a location where the outer pipe is penetrated and a solidifying material discharged from a side of the agitation shaft with each other by agitation blades radially attached to the agitation shaft, thereby forming an improved body having a substantially polygonal cross section.

According to the aforementioned configurations, an outer pipe through which an inner pipe having a fixed sun gear is inserted can be made small in diameter and an improved body having a substantially polygonal cross section can be easily and reliably formed.

DETAILED DESCRIPTION

Figure 1:
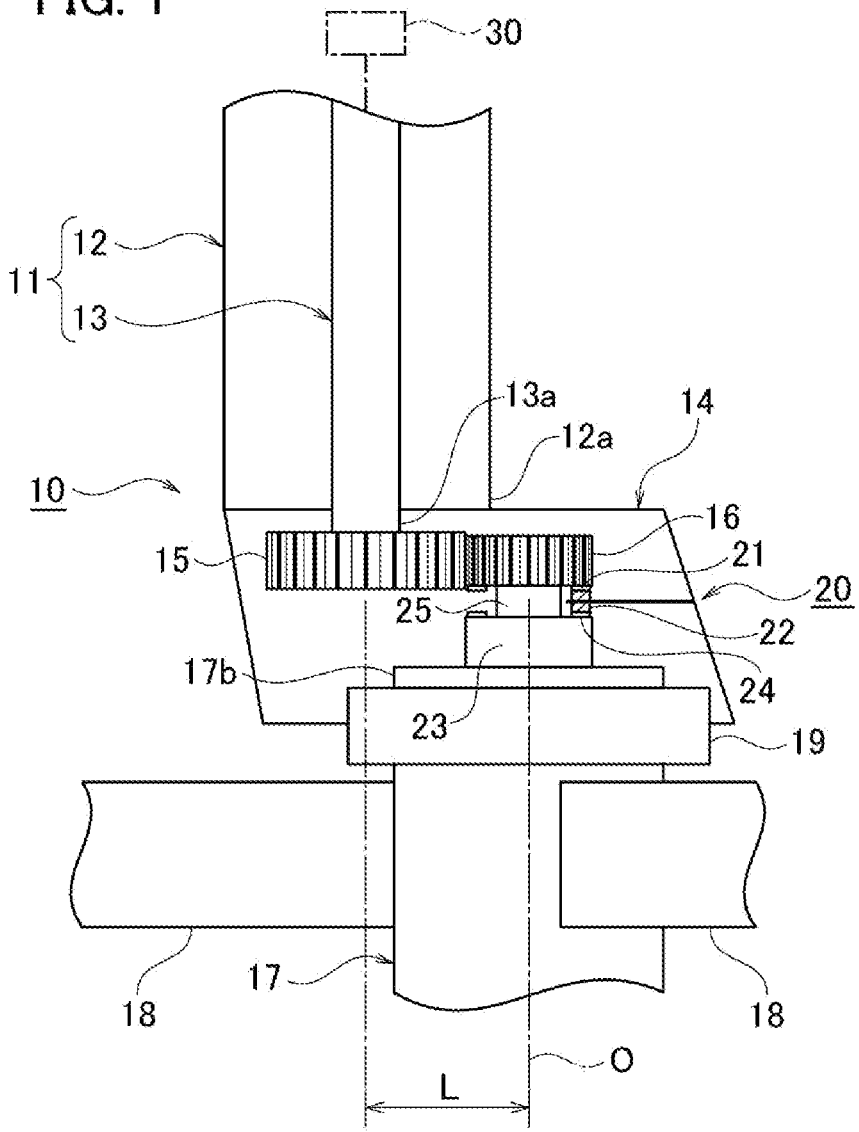
FIG. 1 is a schematic configuration diagram illustrating a main part of a ground improvement apparatus according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
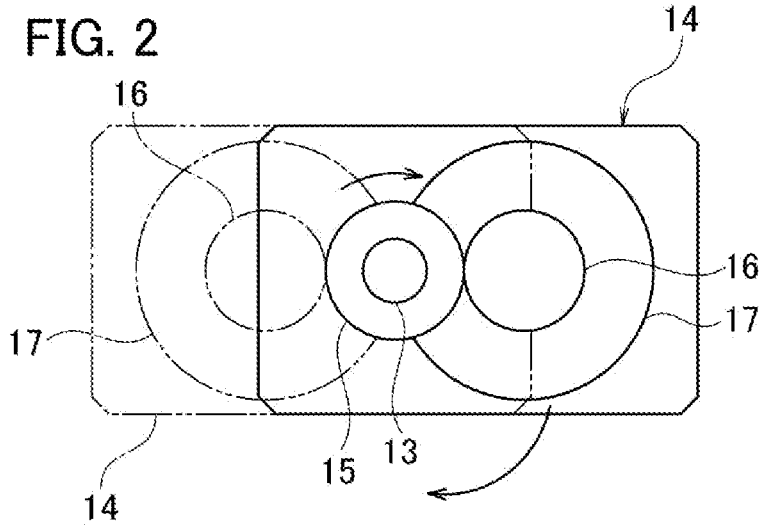
FIG. 2 is a schematic configuration diagram of an interior of a connecting member attached to a distal end of an outer pipe of the ground improvement apparatus.
Figure 3:
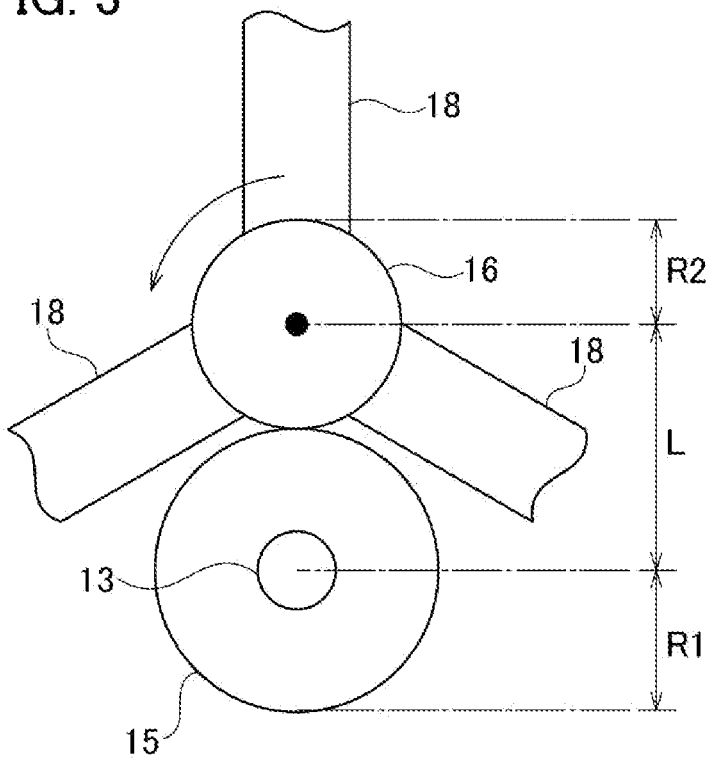
FIG. 3 is an explanatory diagram illustrating a dimensional relationship between a planetary gear and a sun gear fixed to a distal end of an inner pipe inserted into the outer pipe.
Figure 4:
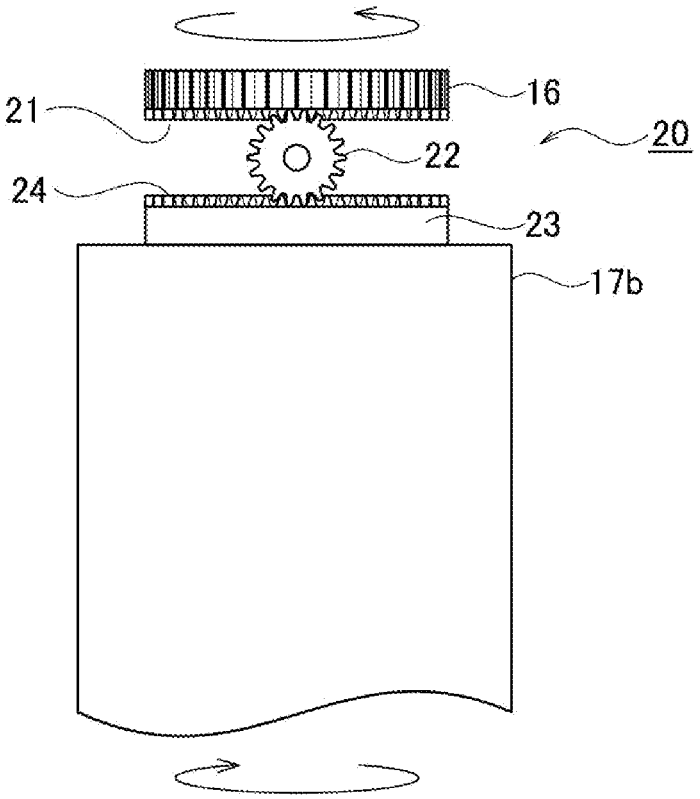
FIG. 4 is a schematic configuration diagram of an inverse rotation mechanism which reversely rotates the planetary gear and an agitation shaft.
Figures 5A, 5B, 5C, 5D, 5E, 5F, 5G:
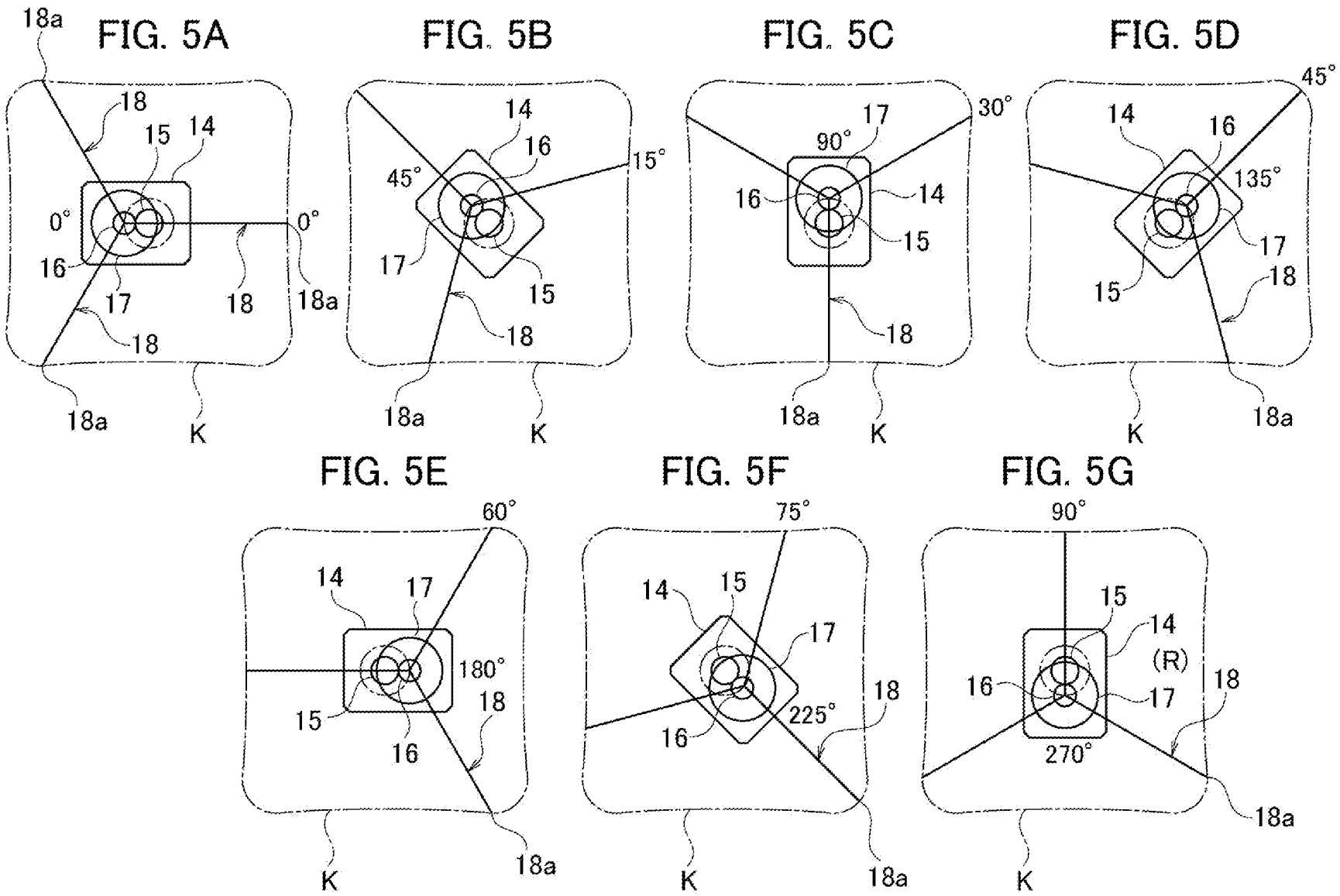
FIGS. 5A to 5G are explanatory diagrams of a substantially regular quadrangular trajectory drawn by distal ends of three agitation blades by rotation of the agitation shaft.

FIG. 1 is a schematic configuration diagram illustrating a main part of a ground improvement apparatus according to a first embodiment of the disclosure, FIG. 2 is a schematic configuration diagram of an interior of a connecting member 14 attached to a distal end 12*a* of an outer pipe 12 of the ground improvement apparatus, FIG. 3 is an explanatory diagram illustrating a dimensional relationship between a planetary gear 16 and a sun gear 15 fixed to a distal end 13*a* of an inner pipe 13 inserted into the outer pipe 12, FIG. 4 is a schematic configuration diagram of an inverse rotation mechanism 20 which reversely rotates the planetary gear 16 and an agitation shaft 17, and FIGS. 5A to 5G are explanatory diagrams of a substantially regular quadrangular trajectory K drawn by distal ends 18*a* of three agitation blades 18 by rotation of the agitation shaft 17.

As illustrated in FIG. 1, the ground improvement apparatus 10 includes a double pipe 11, an agitation shaft 17, a sun gear 15, a planetary gear 16, and an inverse rotation mechanism 20. The double pipe 11 has a cylindrical outer pipe 12 and a cylindrical inner pipe (middle pipe) 13. The outer pipe 12 is rotated by an auger motor 30. The inner pipe 13 is arranged inside the outer pipe 12 so as to extend non-rotatably. The agitation shaft 17 is rotatably suspended via a connecting member 14 attached to a distal end 12*a* of the outer pipe 12 at a prescribed distance (for example, 77 mm) from the outer pipe 12 so as to be parallel to the outer pipe 12. The sun gear 15 is fixed to a distal end 13*a* of the non-rotating inner pipe 13 so as not to rotate. The planetary gear 16 is rotatably supported on an upper end 17*b* side of the agitation shaft 17 and rotates while meshing with the non-rotating sun gear 15. The inverse rotation mechanism 20 meshes with the planetary gear 16 and rotates the agitation shaft 17 in a direction opposite to a rotation direction of the planetary gear 16.

The agitation shaft 17 is provided with three agitation blades 18 extending radially at 120° intervals. The agitation shaft 17 is suspended on the connecting member 14 so as to rotate via an agitation shaft fixing bearing 19 in synchronization with a rotation center O of the inverse rotation mechanism 20. By rotation of the agitation shaft 17, a trajectory K of distal ends 18*a* of the three agitation blades 18 draws a substantially regular quadrangular shape (substantially square shape). That is, a ratio of the number of teeth of the sun gear 15 to the number of teeth of the planetary gear 16 is 4 to 3 and the substantially regular quadrangular shape is formed by the trajectory K of the distal ends 18*a* of the three agitation blades 18 in accordance with the principle of Reuleaux triangle as illustrated in FIGS. 5A to 5G.

As illustrated in FIGS. 1 and 4, the inverse rotation mechanism 20 includes an annular plate-shaped rack 21, an inverse gear 22, a reception gear 23, and a bearing 25. The rack 21 is formed on a lower surface periphery of the planetary gear 16. The inverse gear 22 meshes with the rack 21. The reception gear 23 is fixed to an upper end 17*b* of the agitation shaft 17 and an annular plate-shaped rack 24 with which the inverse gear 22 meshes is formed on an upper surface periphery of the reception gear 23. The bearing 25 is interposed between the planetary gear 16 and the reception gear 23. The inverse gear 22 is a pinion meshing with the rack 21 and the rack 24 of the reception gear 23, however may be a bevel gear meshing with the rack 21 and the rack 24.

The double pipe 11 of the ground improvement apparatus 10 moves up and down through a forced lifting and lowering device (not shown) along a leader (not shown) erected in front of a construction machine body, and the outer pipe 12 of the double pipe 11 is rotated by the auger motor (driver) 30. When penetrating the outer pipe 12 of the double pipe into a ground (not shown), the ground improvement apparatus 10 discharges a slurry-like solidifying material (not shown) from a nozzle (not shown) as a discharge port provided on a distal end side of the agitation shaft 17, and agitates and mixes, by the three agitation blades 18, the ground at a location where the outer pipe 12 has been penetrated with the slurry-like solidifying material discharged from the agitation shaft 17 side, thereby improving the ground by forming an improved body R having a substantially regular quadrangular cross section. As illustrated in FIG. 3, for example, a radius R1 of the sun gear 15 is set to 44 mm, a radius R2 of the planetary gear 16 is set to 33 mm, a distance L from a center of the sun gear 15 to a center of the planetary gear 16 is set to 77 mm, and a radius of each agitation blades 18 is set to 500 mm.

According to the ground improvement apparatus 10 in accordance with the first embodiment, when the improved body R having a substantially square cross section is formed, first, the outer pipe 12 of the double pipe 11 is rotated by the auger motor 30. By the rotation of the outer pipe 12, the agitation shaft 17 suspended via the connecting member 14 attached to the distal end 12*a* of the outer pipe 12 at the prescribed distance from the outer pipe 12 so as to be parallel to the outer pipe 12 is rotated. That is, through the rotation of the outer pipe 12, the planetary gear 16 rotatably supported on a side of the upper end 17*b* of the agitation shaft 17 via the inverse rotation mechanism 20 revolves around the non-rotating sun gear 15 fixed to the distal end 13*a* of the non-rotating inner pipe 13 arranged in the outer pipe 12, and the planetary gear 16 itself also rotates. As a result, as illustrated in FIGS. 5A to 5G, the distal ends 18*a* of the three agitation blades 18 radially attached to the agitation shaft 17 form the substantially regular quadrangular trajectory K. Thus, the ground at the location where the outer pipe 12 is penetrated and the slurry-like solidifying material discharged from the distal end side of the agitation shaft 17 are agitated and mixed with each other by the three agitation blades 18 to form the improved body R having a substantially regular quadrangular cross section.

In this way, the sun gear 15 and the planetary gear 16 with the ratio of the number of teeth of the sun gear 15 to the number of teeth of the planetary gear 16 being 4 to 3 are used and the improved body R having a substantially regular quadrangular cross section is formed by the three agitation blades 18. As a result, the outer pipe 12 through which the inner pipe 13 to which the sun gear 15 is fixed is inserted can be reduced in diameter. Therefore, a large load is not applied when the outer pipe 12 is penetrated into the ground and the improved body R having an substantially regular quadrangular cross section can be smoothly, easily and reliably formed.

In the ground improvement apparatus 10 according to the first embodiment, the planar shape of the sun gear 15 is a perfect circle. Therefore, the improved body R formed by the ground improvement apparatus 10 has a round substantially regular quadrangular shape as illustrated in FIGS. 5A to 5G. However, by changing the planar shape of the sun gear 15 to a shape that is not a perfect circle (for example, a gear or the like having a substantially regular quadrangular shape as a planar shape in which the four corners are removed and rounded), the cross-sectional shape of the improved body R can be made closer to an accurate regular quadrangular shape. In this case, since an inter-axis distance between the axes of the sun gear 15 and the planetary gear 16 is not constant, a variable mechanism (not shown) for varying the inter-axis distance is provided to keep the meshing between the sun gear 15 and the planetary gear 16.

Figure 6:
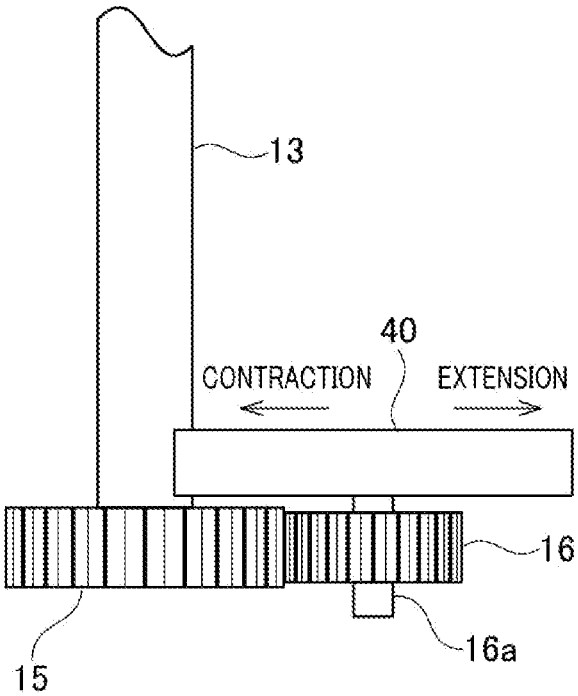
FIG. 6 is a schematic configuration diagram illustrating a main part of a ground improvement apparatus according to a second embodiment.

FIG. 6 is a schematic configuration diagram illustrating a main part of a ground improvement apparatus according to a second embodiment of the disclosure.

The ground improvement apparatus according to the second embodiment is different from the ground improvement apparatus according to the first embodiment in that, even when the distance between the center of the sun gear 15 and the center of the planetary gear 16 changes, meshing between the sun gear 15 and the planetary gear 16 is kept by utilizing the contraction/extension force of a spring (elastic body as a variable mechanism) 40 provided between the distal end 13*a* of the inner pipe 13 and a support shaft 16*a* of the planetary gear 16. Since the other elements are the same as those of the first embodiment, the same elements are denoted by the same reference numerals and detailed descriptions thereof are omitted.

Specifically, the ground improvement apparatus according to the second embodiment supports the sun gear 15 and the planetary gear 16 by using the sun gear 15 having a rounded quadrangular shape similar to the trajectory drawn by the gravity center of the Reuleaux triangle when the Reuleaux triangle is rotated so as to draw a substantially square shape by the trajectory K of the vertices of the Reuleaux triangle, via the spring (variable mechanism) 40 which varies the inter-axis distance between the axes of the sun gear 15 and the planetary gear 16 so that the planetary gear 16 always meshes with the sun gear 15. Thus, an improved body R having a substantially square cross section in which four sides are linear is formed.

In the ground improvement apparatus according to the second embodiment, even when the distance between the center of the sun gear 15 and the center of the planetary gear 16 is changed, the sun gear 15 and the planetary gear 16 are meshed with each other by the contraction/extension force of the spring 40. Therefore, the improved body R can be formed by drawing the more complete regular square than that of the first embodiment by the distal ends 18*a* of the three agitation blades 18.

Figure 7:
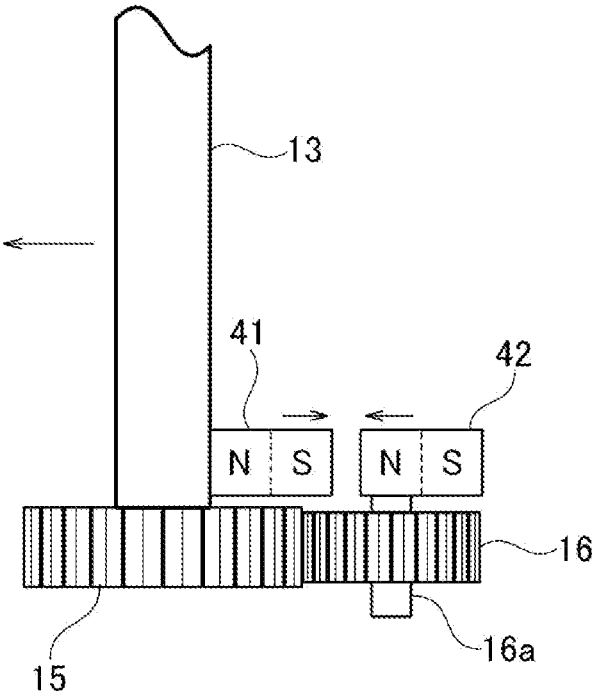
FIG. 7 is a schematic configuration diagram illustrating a main part of a ground improvement apparatus according to a third embodiment.

FIG. 7 is a schematic configuration diagram illustrating a main part of a ground improvement apparatus according to a third embodiment of the disclosure.

The ground improvement apparatus according to the third embodiment is different from the ground improvement apparatus according to the first embodiment in that, even when the distance between the center of the sun gear 15 and the center of the planetary gear 16 changes, the sun gear 15 and the planetary gear 16 are meshed with each other by using a magnetic force between a magnet 41 provided on the distal end 13*a* of the inner pipe 13 and a magnet 42 provided on the support shaft 16*a* of the planetary gear 16. Since the other elements are the same as those of the first embodiment, the same elements are denoted by the same reference numerals and detailed descriptions thereof are omitted.

Specifically, the ground improvement apparatus according to the second embodiment supports the sun gear 15 and the planetary gear 16 by using the sun gear 15 having a rounded quadrangular shape similar to the trajectory drawn by the gravity center of the Reuleaux triangle when the Reuleaux triangle is rotated so as to draw a substantially square shape by the trajectory K of the vertices of the Reuleaux triangle, via the magnets (variable mechanism) 41, 42 which vary the inter-axis distance between the axes of the sun gear 15 and the planetary gear 16 so that the planetary gear 16 always meshes with the sun gear 15. Thus, an improved body R having a substantially square cross section in which four sides are linear is formed.

In the ground improvement apparatus according to the third embodiment, even when the distance between the center of the sun gear 15 and the center of the planetary gear 16 is changed, the sun gear 15 and the planetary gear 16 are meshed with each other by the magnetic force of the magnet 41 and the magnet 42 facing each other. Therefore, the improved body R can be formed by drawing the more complete regular square than that of the first embodiment by the distal ends 18*a* of the three agitation blades 18.

Figure 8:
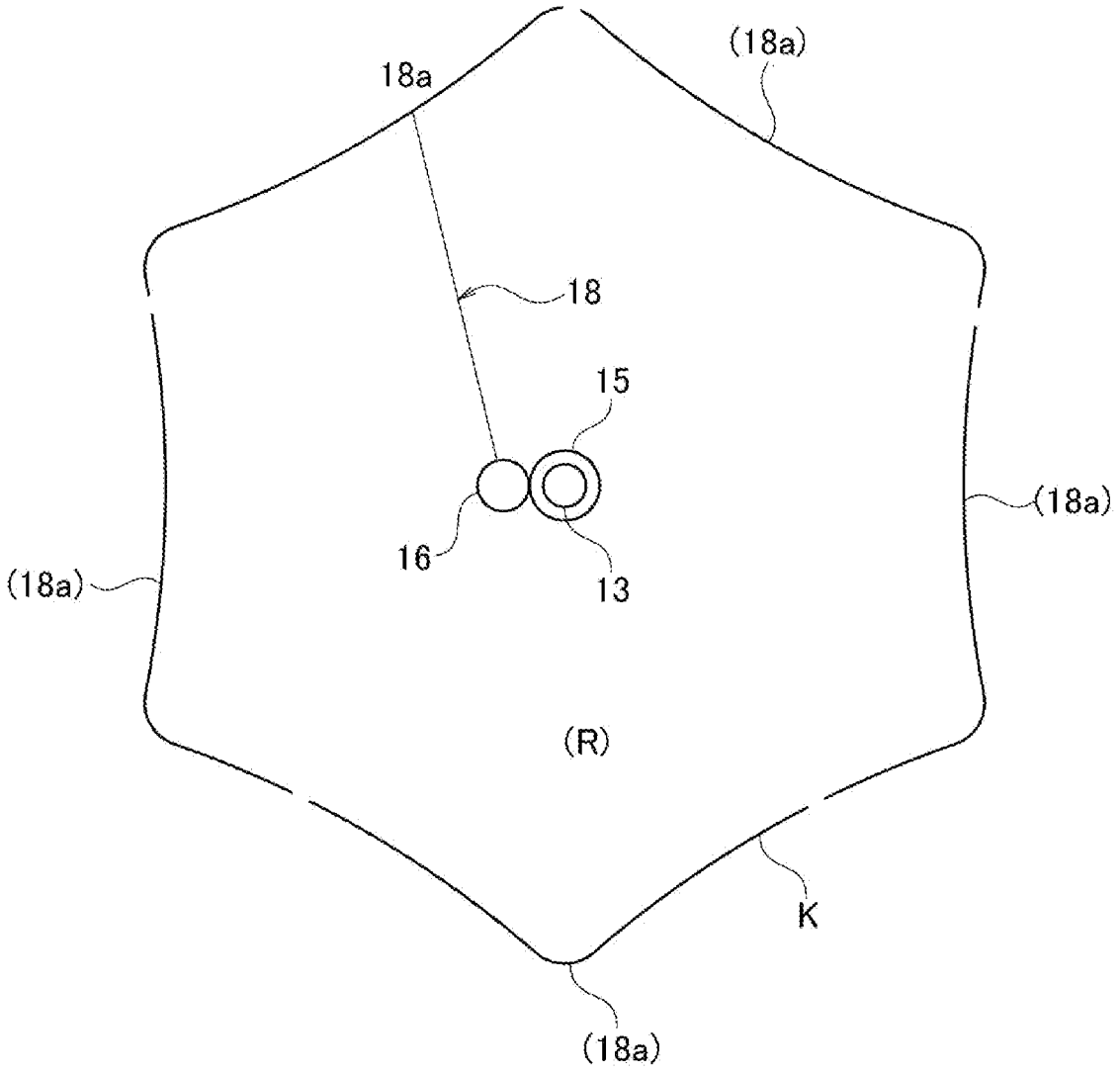
FIG. 8 is an explanatory diagram of a substantially regular hexagon trajectory drawn by distal ends of five agitation blades by rotation of an agitation shaft of a ground improvement apparatus according to a fourth embodiment.

FIG. 8 is an explanatory diagram of a substantially regular hexagon trajectory K drawn by distal ends 18*a* of five agitation blades 18 by rotation of an agitation shaft 17 of a ground improvement apparatus according to a fourth embodiment of the disclosure.

The ground improvement apparatus according to the fourth embodiment is different from the ground improvement apparatus according to the first embodiment in that a sun gear 15 and a planetary gear 16 with the ratio of the number of teeth of the sun gear 15 to the number of teeth of the planetary gear 16 being 6 to 5 are used and the trajectory K having a substantially regular hexagon shape is formed by the distal ends 18*a* of the five agitation blades 18. Since the other elements are the same as those of the first embodiment, the same elements are denoted by the same reference numerals and detailed description thereof is omitted.

In the ground improvement apparatus according to the fourth embodiment, the improved body R having a substantially regular hexagonal cross section can be easily and reliably prepared by the five agitation blades 18 by using the sun gear 15 and the planetary gear 16 with the ratio of the number of teeth of the sun gear 15 to the number of teeth of the planetary gear 16 being 6 to 5.

In the above embodiments, the agitation blades 18 are radially attached to the agitation shaft 17. However, an excavation bit may be attached to the distal end of the agitation shaft 17 to excavate the ground and form the improved body of the ground.

In the above embodiments, the agitation shaft 17 is provided with the discharge port for discharging the slurry-like solidifying material. However, a discharge port(s) for discharging the slurry-like solidifying material may be provided in the agitation blade(s) 18.

Further, in the above embodiments, the sun gear 15 and the planetary gear 16 with the ratio of the numbers of their teeth being 4 to 3 are used and the improved body R having a substantially regular square cross section is formed by the three agitation blades 18, or the sun gear 15 and the planetary gear 16 with the ratio of the numbers of their teeth being 6 to 5 are used and the improved body R having a substantially regular hexagonal cross section is formed by the five agitation blades 18. However, the sun gear 15 and the planetary gear 16 with the ratio of the numbers of their teeth being 8 to 7 may be used and the improved body R having a substantially regular octagon cross section may be formed by the seven agitation blades 18.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A ground improvement apparatus, comprising:

a double pipe including an outer pipe rotated by a driver and an inner pipe irrotationally extended and arranged inside the outer pipe;

an agitation shaft rotatably suspended via a connection member attached to a distal end of the outer pipe at a prescribed distance from the outer pipe so as to be parallel to the outer pipe;

a sun gear fixed to a distal end of the irrotational inner pipe so as not to rotate;

a planetary gear rotatably supported on an upper end side of the agitation shaft and configured to rotate while meshing with the irrotational sun gear; and an inverse rotation mechanism configured to mesh with the planetary gear and rotate the agitation shaft in a direction opposite to a rotation direction of the planetary gear, wherein the agitation shaft radially includes agitation blades and is suspended on the connection member so as to rotate in synchronization with a rotation center of the inverse rotation mechanism, and wherein a ground at a location where the outer pipe is penetrated and a solidifying material discharged from a side of the agitation shaft are agitated and mixed with each other by the agitation blades with a trajectory of distal ends of the agitation blades drawing a substantially polygonal shape by rotation of the agitation shaft.

2. The ground improvement apparatus according to claim 1, wherein the inverse rotation mechanism comprises:

a rack formed on a lower surface periphery of the planetary gear;

an inverse gear configured to mesh with the rack; and a reception gear having an upper surface periphery formed with a rack meshed with the inverse gear and fixed to an upper end of the agitation shaft.

3. The ground improvement apparatus according to claim 2, wherein an improved body having a substantially square cross section in which four sides are linear is formed by supporting the sun gear and the planetary gear via a variable mechanism configured to vary an inter-axis distance between the planetary gear and the sun gear so that the planetary gear always meshes with the sun gear, using the sun gear having a round quadrangular shape similar to a trajectory drawn by a gravity center of a Reuleaux triangle when the Reuleaux triangle is rotated so as to draw a substantially square shape by a trajectory of vertices of the Reuleaux triangle.

4. The ground improvement apparatus according to claim 1, wherein a ratio of a number of teeth of the sun gear to a number of teeth of the planetary gear is 4 to 3, a number of the agitation blades is 3, and the trajectory of the distal ends of the three agitation blades forms a substantially square shape.

5. The ground improvement apparatus according to claim 4, wherein an improved body having a substantially square cross section in which four sides are linear is formed by supporting the sun gear and the planetary gear via a variable mechanism configured to vary an inter-axis distance between the planetary gear and the sun gear so that the planetary gear always meshes with the sun gear, using the sun gear having a round quadrangular shape similar to a trajectory drawn by a gravity center of a Reuleaux triangle when the Reuleaux triangle is rotated so as to draw a substantially square shape by a trajectory of vertices of the Reuleaux triangle.

6. The ground improvement apparatus according to claim 1, wherein an improved body having a substantially square cross section in which four sides are linear is formed by supporting the sun gear and the planetary gear via a variable mechanism configured to vary an inter-axis distance between the planetary gear and the sun gear so that the planetary gear always meshes with the sun gear, using the sun gear having a round quadrangular shape similar to a trajectory drawn by a gravity center of a Reuleaux triangle when the Reuleaux triangle is rotated so as to draw a substantially square shape by a trajectory of vertices of the Reuleaux triangle.

7. The ground improvement apparatus according to claim 1, wherein the inverse rotational mechanism is arranged under the planetary gear.

8. A ground improvement method, comprising:

rotating an outer pipe of a double pipe by a driver;

rotating an agitation shaft suspended via a connection member attached to a distal end of the outer pipe at a prescribed distance from the outer pipe so as to be parallel to the outer pipe and so as to rotate the agitation shaft in synchronization with a rotation center of an inverse rotation mechanism;

through rotation of the outer pipe, revolving a planetary gear around a sun gear and rotating the planetary gear and the inverse rotation mechanism, the sun gear being irrotational and fixed to a distal end of an inner pipe irrotationally arranged inside the outer pipe, the planetary gear being rotatably supported on an upper end side of the agitation shaft and configured to rotate while meshing with the sun gear, the inverse rotation mechanism being configured to mesh with the planetary gear and rotate the agitation shaft in a direction opposite to a rotation direction of the planetary gear; and agitating and mixing a ground at a location where the outer pipe is penetrated and a solidifying material discharged from a side of the agitation shaft with each other by agitation blades radially attached to the agitation shaft, thereby forming an improved body having a substantially polygonal cross section.

9. The ground improvement method according to claim 8, comprising forming the improved body having a substantially square cross section by the three agitation blades using the sun gear and the planetary gear with a ratio of a number of teeth of the sun gear to a number of teeth of the planetary gear being 4 to 3.

10. The ground improvement method according to claim 8, wherein the inverse rotational mechanism is arranged under the planetary gear.

* * * * *